US005759981A

United States Patent [19]

Boutique et al.

[11] Patent Number: 5,759,981

[45] Date of Patent: Jun. 2, 1998

[54] PROCESS FOR TREATING TEXTILES AND COMPOSITIONS THEREFOR

[75] Inventors: Jean-Pol Boutique, Gembloux, Belgium; Mark William Glogowski, Cincinnati, Ohio; Frederick Edward Hardy, Newcastle upon Tyne, England; James Pyott Johnston, Overijse; Regine Labeque, Brussels, both of Belgium; Bruce Prentiss Murch; Rajan Keshav Panandiker, both of Cincinnati, Ohio

[73] Assignee: The Procter & Gamble Company, Cincinnati, Ohio

[21] Appl. No.: 750,240

[22] PCT Filed: Jun. 12, 1995

[86] PCT No.: PCT/US95/07440

§ 371 Date: Dec. 4, 1996

§ 102(e) Date: Dec. 4, 1996

[87] PCT Pub. No.: WO95/35357

PCT Pub. Date: Dec. 28, 1995

[30] Foreign Application Priority Data

Jun. 22, 1994 [EP] European Pat. Off. ..... 94304532

[51] Int. Cl.[6] ..... C11D 1/65

[52] U.S. Cl. ..... 510/304; 510/309; 510/311; 510/351; 510/357; 510/371; 510/372; 510/504

[58] Field of Search ..... 510/304, 309, 510/311, 338, 340, 351, 356, 357, 371, 372, 375, 384, 407, 414, 503, 504

[56] References Cited

U.S. PATENT DOCUMENTS

| | | | |
|---|---|---|---|
| H1468 | 8/1995 | Costa et al. | 252/174.12 |
| 5,174,927 | 12/1992 | Honsa | 252/543 |
| 5,223,179 | 6/1993 | Connor et al. | 252/548 |
| 5,445,651 | 8/1995 | Thoen et al. | 8/111 |
| 5,560,748 | 10/1996 | Surutzidis et al. | 8/111 |

*Primary Examiner*—Paul Lieberman
*Assistant Examiner*—John R. Hardee
*Attorney, Agent, or Firm*—Ken K. Patel; Kim W. Zerby; Jacobus C. Rasser

[57] ABSTRACT

Treatment of textiles whereby the textiles are contacted with a medium comprising a bleach, anionic species and a neutralizing system for the anionic species, wherein the neutralizing system comprises quaternary ammonium compounds. The composition for textile treatment contains less than 10% by weight of water, and is essentially free of alkanolamines. The composition may further contain a metallo catalyst.

18 Claims, No Drawings

PROCESS FOR TREATING TEXTILES AND COMPOSITIONS THEREFOR

TECHNICAL FIELD OF THE INVENTION

The present invention relates to a process for treating textiles and liquid detergent compositions for use in said process. The compositions of the present invention comprise a bleaching system.

BACKGROUND OF THE INVENTION

The object of the present invention is to provide a process for the treatment of textiles, whereby the textiles are contacted in an aqueous medium with a bleaching system and optionally a metallo catalyst. The bleach and metallo catalyst in combination serve as a bleaching system or as a dye transfer inhibition system. It is a further object of the present invention to provide a composition suitable for use in the above process.

It is highly desirable that the textiles are contacted with an aqueous medium that comprises certain anionic species such as anionic surfactants, builders and the like, as this results in improved cleaning. Anionic species present in the medium need to be neutralized, by a neutralizing system. Often, the anionic species, especially anionic surfactants are incorporated into detergent compositions already neutralized. Other anionic species such as builders may be neutralized in the composition or more rarely in the aqueous medium itself which is contacted with the textiles. If, for example the anionic surfactant is not neutralized during the wash and is allowed to remain acidic, the cleaning performance of the composition will be impaired and the whiteness performance of the composition will be detrimentally affected. Thus, the neutralizing system is a vital constituent in the medium. Commonly described neutralizing system used for anionic species in the art, include sodium hydroxide and alkanolamines in general particularly monoethanolamine. However when considering the choice of neutralizing systems the other ingredients' compatibility in the wash liquor must be considered.

One such ingredient is a bleach, which is required for improving the cleaning and whiteness performance of the wash process. In addition the bleaching system is required for the bleaching of fabrics and as well as stains on fabrics. In particular the presence of a bleach maybe used in combination with a metallo catalyst to provide the bleaching system.

Unfortunately, we have now found that the bleach can oxidize alkanolamines such as monoethanolamine and is therefore incompatible with the organic neutralizing agents. This problem occurs whenever the bleach and the monoethanolamine come in contact with one another. Thus, this problem may occur in the composition formulation and in the aqueous medium of the wash liquor, if for example the bleach and the monoethanolamine are kept separate until the wash process begins. Therefore, monoethanolamine was not found to be a suitable neutralizing system.

In addition to providing whiteness bleaching benefits, bleach in combination with a metallo catalyst provide the benefit of preventing the transfer of dyes from one textile to another during the wash and thereby improving whiteness maintenance. Therefore it is highly desirable that these ingredients are incorporated in the aqueous medium. Such DTI systems have been disclosed in for example the copending European Patent Application Nos.: 92870181, 92870184.6 and 92870183.8. However there are a number of problems associated with the presence of DTI systems. In the aqueous medium the metallo catalyst is activated by the bleach and it is this activated species which inhibits dye transfer. We have now found that this species is very sensitive to the other components in the aqueous medium, particularly the neutralizing system for the anionic species. For example monoethanolamine and all other alkanolamines immediately deactivate the activated metallo catalyst and thus are not suitable for the present invention.

In response to these objectives it has now been found that neutralizing systems for the neutralization of anionic species comprising quaternary ammonium cations according to the formula:

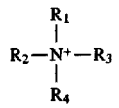

wherein $R_1$–$R_4$ are independently $C_1$–$C_6$ alkyl, phenyl, hydroxyalkyl or alkoxyalkyl groups are compatible with peroxygen bleach and optionally a metallo catalyst.

Quaternary ammonium compounds are known in the art. DDR 123 531 discloses anhydrous detergent compositions comprising anionic surfactants and alkanolamine quaternary ammonium base. There is no disclosure of tetramethylammonium or bleach systems.

DDR 120 051 discloses anhydrous detergent compositions comprising surfactants and quaternary ammonium bases with $C_1$–$C_4$ alkyl groups. There is no mention of bleach systems.

SUMMARY OF THE INVENTION

The present invention is a process for treating textiles whereby said textiles are contacted with an aqueous medium comprising a bleach and optionally a metallo catalyst, anionic species and a neutralizing system for said anionic species, characterized in that said neutralizing system comprises quaternary ammonium cations according to the formula:

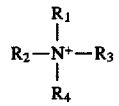

wherein $R_1$–$R_4$ are independently $C_1$–$C_6$ alkyl, phenyl, hydroxylalkyl or alkoxyalkyl groups.

The present invention further encompasses a composition comprising anionic species and a bleach and optionally a metallo catalyst and a neutralizing system for said anionic species characterized in that said neutralizing system comprises quaternary ammonium cations according to the formula:

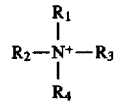

wherein $R_1$–$R_4$ are independently $C_1$–$C_6$ alkyl, phenyl, hydroxylalkyl or alkoxyalkyl groups. The preferred quaternary ammonium compound is Tetra Methyl Ammonium (TMA). The preferred neutralizing agent is Tetra Methyl Ammonium Hydroxide (TMA.OH).

All weights ratios and percentages are given by the % weight of the total composition unless otherwise stated.

DETAILED DESCRIPTION OF THE INVENTION

The Process of the Invention

The present invention is a process for treating textiles whereby said textiles are contacted with an aqueous medium comprising a bleach and optionally a metallo catalyst, anionic species and a neutralizing system for said anionic species, characterized in that said neutralizing system comprises quaternary ammonium cations according to the formula:

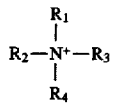

wherein $R_1$–$R_4$ are independently $C_1$–$C_6$ alkyl, phenyl, hydroxylalkyl or alkoxyalkyl groups. The preferred quaternary ammonium compound is Tetra Methyl Ammonium (TMA). The preferred neutralizing agent is Tetra Methyl Ammonium Hydroxide (TMA.OH).

In another embodiment of the process of the present invention said medium is formed by mixing together in water, a first non aqueous composition comprising a bleach and a metallo catalyst, and a second composition comprising anionic species and said quaternary ammonium cations.

According to the present invention the treatment of textiles includes washing processes such as machine washing process and hand washing processes, textile softening treatments, softening-through-the wash treatments, prewash treatments, whereby the textiles are contacted in any manner to the aqueous medium of the present invention.

Anionic Species

Thus, according to the present invention an essential ingredient of the aqueous medium are anionic species. The anionic species are completely dissolved in the aqueous medium.

Anionic species suitable for use herein include anionic surfactants and builders. Suitable anionic surface-active salts are selected from the group of sulphonates and sulphates. The like anionic surfactants are well-known in the detergent art and have found wide application in commercial detergents. Preferred anionic water-soluble sulphonate or sulfate salts have in their molecular structure an alkyl radical containing from about 8 to about 22 carbon atoms. Examples of such preferred anionic surfactant salts are the reaction products obtained by sulfating $C_8$–$C_{18}$ fatty alcohols derived from e.g. tallow oil, palm oil, palm kernel oil and coconut oil; alkylbenzene sulphonates wherein the alkyl group contains from about 9 to about 15 carbon atoms; sodium alkylglyceryl ether sulphonates; ether sulfates of fatty alcohols derived from tallow and coconut oils; coconut fatty acid monoglyceride sulfates and sulphonates; and water-soluble salts of paraffin sulphonates having from about 8 to about 22 carbon atoms in the alkyl chain. Sulphonated olefin surfactants as more fully described in e.g. U.S. Pat. No. 3,332,880 can also be used. The counterion of the above anionic surfactant can be quaternary ammonium cation according to the present invention.

A suitable anionic synthetic surfactant herein is represented by the water-soluble salts of an alkylbenzene sulphonic acid, preferably alkylbenzene sulphonates, preferably alkylbenzene sulphonates having from about 10 to 13 carbon atoms in the alkyl group. Another preferred anionic surfactant moiety herein is alkyl sulphate having from about 10 to 15 carbon atoms in the alkyl group.

Another anionic surfactant suitable for use herein can be alkyl alkoxylated sulphate surfactants. Alkyl alkoxylated sulphate surfactants hereof are water soluble salts of the formula $RO(A)_mSO_3M$ wherein R is an $C_{10}$–$C_{24}$ alkyl or hydroxylalkyl group having a $C_{10}$–$C_{24}$ alkyl component, preferably a $C_{12}$–$C_{18}$ alkyl or hydroxylalkyl. A is an ethoxy or propoxy unit, m is greater than zero, typically between about 0.5 and about 6, more preferably between about 0.5 and 3, and M is the quaternary ammonium cation of the present invention. Exemplary surfactants are $C_{12}$–$C_{18}$ alkyl polyethoxylate (1.0) sulphate ($C_{12}$–$C_{18}$E(1.0)M), $C_{12}$–$C_{18}$ alkyl polyethoxylate (2.25) sulphate ($C_{12}$–$C_{18}$E(2.25)M), $C_{12}$–$C_{18}$ alkyl polyethoxylate (3.0) sulphate ($C_{12}$–$C_{18}$E(3.0)M), $C_{12}$–$C_{18}$ alkyl polyethoxylate (4.0) sulphate ($C_{12}$–$C_{18}$E(4.0)M).

Another type of anionic surfactant suitable for use herein are alkyl ester sulphonate, which can be synthesized according to known methods disclosed in the technical literature. For instance, linear esters of $C_8$–$C_{20}$ carboxylic acids can be sulphonated with gaseous $SO_3$ according to "The Journal of the American Oil Chemists Society", 52 (1975), pp. 323–329. Suitable starting materials would include natural fatty substances as derived from tallow, palm and coconut oils. The preferred alkyl ester sulphonate, comprise alkyl ester sulphonates of the structural formula:

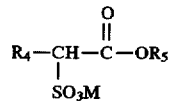

wherein $R_4$ is a $C_8$–$C_{20}$ hydrocarbyl, preferably an alkyl or combination thereof, $R_5$ is a $C_1$–$C_6$ hydrocarbyl, preferably an alkyl or combination thereof and M is a quaternary ammonium cation of the present invention. Preferably $R_4$ is $C_{10}$–$C_{16}$ alkyl and $R_5$ is methyl, ethyl or isopropyl. Especially preferred are the methyl ester sulphonates wherein $R_4$ is $C_{14}$–$C_{16}$ alkyl.

Thus detergent compositions for use in the process herein comprise from 2% to 90% by weight of said anionic surfactant, preferably from 4% to 50%, most preferably from 5% to 30% by weight of said anionic surfactant.

Builders suitable for use herein may be any conventional builder including polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable polycarboxylates builders for use herein include citric acid, preferably in the form of a water-soluble salt, derivatives of succinic acid of the formula R $CH(COOH)CH_2(COOH)$ wherein R is $C_{10-20}$ alkyl or alkenyl, preferably $C_{12-16}$, or wherein R can be substituted with hydroxyl, sulpho sulphoxyl or sulphone substituents. Specific examples include lauryl succinate, myristyl succinate, palmityl succinate, 2-dodecenylsuccinate, 2-tetradecenyl succinate. Other suitable polycarboxylates are oxodisuccinates and mixtures of tartrate monosuccinic and tartrate disuccinic acid such as described in U.S. Pat. No. 4,663,071.

Suitable fatty acid builders for use herein are saturated or unsaturated $C_{10-18}$ fatty acids, as well as the corresponding soaps. Preferred saturated species have from 12 to 16 carbon atoms in the alkyl chain. The preferred unsaturated fatty acid is oleic acid.

A preferred builder system for use herein consists of a mixture of citric acid and fatty acids. The builder system preferably represents from 2% to 40%, preferably from 5% to 20% by weight of the total composition for use in the process of the present invention. According to the present invention the composition comprises from 2% to 90%, preferably from 5% to 60% of said anionic species.

It has been found that said anionic species can be neutralized without precipitation in the formulation or in the aqueous medium by a neutralizing system comprising quaternary ammonium cations. Said quaternary ammonium cations are compatible with a bleach and metallo catalysts.

Quaternary Ammonium Compound

Thus another essential component of the aqueous medium of the present invention is a quaternary ammonium cation to the formula:

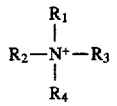

wherein $R_1$–$R_4$ are independently $C_1$–$C_6$ alkyl, phenyl, hydroxyalkyl or alkoxyalkyl groups and mixtures thereof. According to the present invention $R_1$–$R_4$ are preferably independently $C_1$ to $C_4$, groups, most preferably are independently $C_1$ to $C_3$ groups and mixtures thereof. A preferred quaternary ammonium cation for use herein is tetramethyl ammonium.

Bleach

Another essential component of the aqueous medium according to the present invention is a bleach. Suitable peroxygen bleaches compounds include perborates, persulphates, percarbonates, peroxydisulphates, perphosphates and the crystalline peroxyhydrates formed by reacting hydrogen peroxide with sodium carbonate and urea. Preferred are sodium perborate, monohydrate and tetrahydrate and sodium percarbonate.

Hydrogen peroxide releasing agents can be used in combination with bleach activators such as tetraacetylehtylenediamine (TAED), nonanoyloxybenzene sulphonate (NOBS, described in U.S. Pat. No. 4,412,934), 3,5,5-trimethylhexanoloxybenzenesulphonate (ISONOBS, described in EP 120 591), or pentaacetylglucose (PAG) which are perhydrolysed to form peracid as the active bleaching species, which leads to improved bleaching effects.

Other suitable bleach systems for use herein include peroxyacids, perfatty acids, singlet oxygen, chlorine bleaches and enzymatic bleaches.

The compositions for use in the process according to the present invention comprise from 1% to 30% of said bleach, preferably from 5% to 20%, in the absence of a metallo catalyst. In the presence of a metallo catalyst the compositions for use in the process according to the present invention comprise an efficient amount of bleach, which refers herein to the amount of bleach which leads to a level of dye oxidation which is 40% to 100%, preferably 40% to 60%, more preferred 60% to 80%, most preferably 80% to 100% of the maximum (Z) per cent of dye oxidation that can be achieved under the most optimal conditions determined by those skilled in the art.

Test Methods to determine the efficient amount of bleach required if a metallo catalyst is present:

For a given catalyst concentration, temperature and pH, the following two test methods can be used to estimate the optimum bleach level that gives the maximum level of dye oxidation, i.e. Z.

(a) In solution dye bleaching:

In a detergent solution, fix the initial concentration of dye (e.g. 40 ppm) and catalyst. Record the absorbance spectrum of this solution using a UV-Vis spectrophotometer according to procedures known to those skilled in the art. Add a given concentration of bleach ($H_2O_2$, oxone, percarbonate, perborate, activated bleach, etc.) and stir the solution containing the dye and catalyst. After stirring for 30 min, record again the absorbance spectrum of the solution. The amount of dye oxidation can then be determined from the change in the absorbance maximum for the dye. Keeping the experimental conditions the same, vary the amount of bleach so as to achieve the maximum dye oxidation.

(b) Reduction of dye transfer from fabric to another fabric

In either a washing machine or launderometer, add a known bleeding fabric and a known uncoloured pick-up tracer (e.g. cotton) to the wash load. After simulating a wash cycle, determine the amount of dye that has been picked up by the tracer according to methods known to those skilled in the art. Now to separate washing machines, add the same amount of bleeding fabric and pick-up tracer, a fixed amount of catalyst and vary the bleach level. Determine the level of dye transfer onto the pick tracers and vary the amount of bleach as to minimize dye transfer according to standard optimization method known to those skilled in the art. In this way the most optimal bleach concentration can be determined.

Metallo catalyst bleaching system

According to the present invention may also provide fabric bleaching. The bleaching system is preferably a dye transfer inhibition system. Suitable dye transfer inhibiting systems for use herein include DTI systems comprising a metallo catalyst and said bleach. It is highly desirable to incorporate metallo catalysts into the aqueous medium in order to bleach any fugative dyes present thereby preventing the dye from being transferred to other items in the wash.

Suitable metallo catalysts for use herein may be selected from:

a) metallo porphin and water-soluble or water-dispersible derivatives thereof;

b) metallo porphyrin and water-soluble or water-dispersible derivatives thereof;

c) metallo phthalocyanine and water-soluble or water-dispersible derivatives thereof;

The preferred usage range of the catalyst in the wash is $10^{-8}$ molar to $10^{-3}$ molar, more preferred $10^{-6}$–$10^{-4}$ molar.

The essential metallo porphin structure may be visualized as indicated in Formula I in the accompanying drawings. In Formula I the atom positions of the porphin structure are numbered conventionally and the double bonds are put in conventionally. In other formula, the double bonds have been omitted in the drawings, but are actually present as in I.

Preferred metallo porphin structures are those substituted at one or more of the 5, 10, 15 and 20 carbon positions of Formula I (Meso positions), with a phenyl or pyridyl substituent selected from the group consisting of

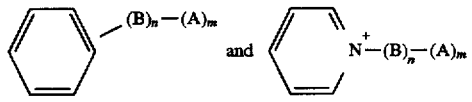

wherein n and m may be 0 or 1; A is selected from water-solubilizing group, e.g., sulfate, sulphonate, phosphate, and carboxylate groups; and B is selected from the group consisting of $C_1$–$C_{10}$ alkyl, $C_1$–$C_{10}$ polyethoxy alkyl and $C_1$–$C_{10}$ hydroxyalkyl.

Preferred molecules are those in which the substituents on the phenyl or pyridyl groups are selected from the group consisting of $—CH_3$, $—C_2H_5$, $—CH_2CH_2CH_2SO_3—$, $—CH_2—$, and $—CH_2CH(OH)CH_2SO_3—$, $—SO_3$ A particularly preferred metallo phorphin is one in which the molecule is substituted at the 5, 10 15, and 20 carbon positions with the substituent

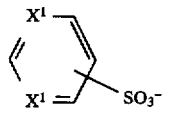

This preferred compound is known as metallo tetrasulfonated tetraphenylporphin. The symbol $X^1$ is (=CY—) wherein each Y, independently, is hydrogen, chlorine, bromine, fluorine or meso substituted alkyl, cycloalkyl, aralkyl, aryl, alkaryl or heteroaryl.

The symbol $X^2$ of Formula I represents an anion, preferably $OH^-$ or $Cl^-$. The compound of Formula I may be substituted at one or more of the remaining carbon positions with $C_1$–$C_{10}$ alkyl, hydroxyalkyl or oxyalkyl groups.

(I)

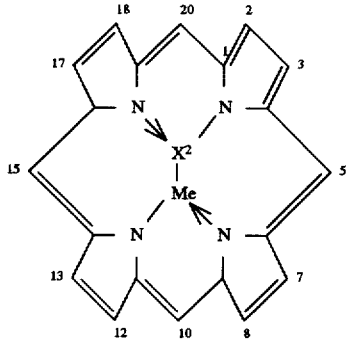

Porphin derivatives also include chlorophyls, chlorines, i.e. isobacterio chlorines and bacteriochlorines.

Metallo porphyrin and water-soluble or water-dispersible derivatives thereof have a structure given in formula II.

(II)

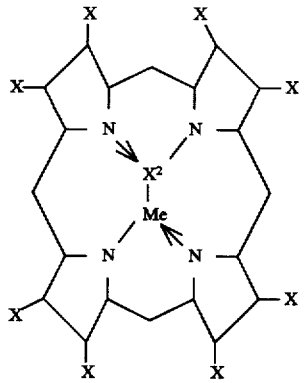

where X can be alkyl, alkyl carboxy, alkyl hydroxyl, vinyl, alkenyl, alkyl sulfate, alkylsulphonate, sulfate, sulphonate, aryl.

The symbol $X^2$ of Formula II represents an anion, preferably $OH^-$ or $Cl^-$. The symbol $X_i$ can be alkyl, alkylcarboxy, alkylhydroxyl, vinyl, alkenyl, alkylsulfate, alkylsulfonate, sulfate, sulfonate.

Metallo phthalocyanine and derivatives have the structure indicated in Formula III, wherein the atom positions of the phthalocyanine structure are numbered conventionally. The anionic groups in the above structures contain cations selected from the group consisting of sodium and potassium cations or other non-interfering cations which leave the structures water-soluble. Preferred phthalocyanine derivatives are metallo phthalocyanine trisulfonate and metallo phthalocyanine tetrasulfonate.

(III)

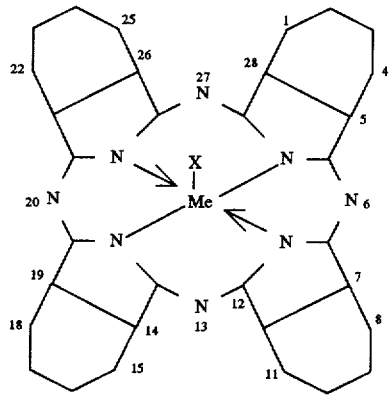

Another form of substitution possible for the present invention is substitution of the central metal by iron, manganese, cobalt, chromium, rhodium, ruthenium, Molybdenum or other transition metals. Still a number of considerations are significant in selecting variants of or substituents in the basic porphin or azaporphin structure. In the first place, one would choose compounds which are available or can be readily synthesized.

Beyond this, when the metallo catalyst is used for dye transfer inhibition the choice of the substituent groups can be used to control the solubility of the catalyst in water or in detergent solutions. Yet again, especially where it is desired to avoid attacking dyes attached to solid surfaces, the substituents can control the affinity of the catalyst compound for the surface. Thus, strongly negatively charged substituted compounds, for instance the tetrasulfonated porphin, may be repelled by negatively charged stained surfaces and are therefore most likely not to cause attack on fixed dyes, whereas the cationic or zwitterionic compounds may be attracted to, or at least not repelled by such stained surfaces.

In addition to the metallo catalyst the dye transfer inhibition system may further comprise polyamine N-oxide polymers.

Polyamine N-oxide polymers suitable for use herein contain units having the following structure formula:

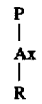

wherein P is a polymerisable unit, whereto the R—N—O group can be attached to or wherein the R—N—O group forms part of the polymerisable unit or a combination of both.

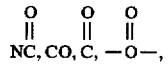

—S—, —N— ; x is or 0 or 1; R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

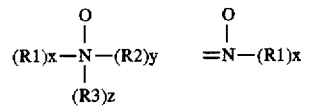

wherein R1, R2, R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisable unit (P) or can be attached to the polymeric backbone or a combination of both. Suitable polyamine N-oxides wherein the N—O group forms part of the polymerisable unit comprise polyamine N-oxides wherein R is selected from aliphatic, aromatic, alicyclic or heterocyclic groups.

One class of said polyamine N-oxides comprises the group of polyamine N-oxides wherein the nitrogen of the N—O group forms part of the R-group. Preferred polyamine N-oxides are those wherein R is a heterocyclic group such as pyridine, pyrrole, imidazole, pyrrolidine, piperidine and derivatives thereof. Another class of said polyamine N-oxides comprises the group of polyamine N-oxides wherein the nitrogen of the N—O group is attached to the R-group.

Other suitable polyamine N-oxides are the polyamine oxides whereto the N—O group is attached to the polymerisable unit. Preferred class of these polyamine N-oxides are the polyamine N-oxides having the general formula (I) wherein R is an aromatic, heterocyclic or alicyclic groups wherein the nitrogen of the N—O functional group is part of said R group.

Examples of these classes are polyamine oxides wherein R is a heterocyclic compound such as pyridine, pyrrole, imidazole and derivatives thereof.

Another preferred class of polyamine N-oxides are the polyamine oxides having the general formula (I) wherein R are aromatic, heterocyclic or alicyclic groups wherein the nitrogen of the N—O functional group is attached to said R groups. Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyimides, polyacrylates and mixtures thereof.

The amine N-oxide polymers typically have a ratio of amine to the amine N-oxide of 10:1 to 1:1000000. However the amount of amine oxide groups present in the polyamine oxide polymer can be varied by appropriate copolymerization or by appropriate degree of N-oxidation. Preferably, the ratio of amine to amine N-oxide is from 3:1 to 1:1000000. The polymers of the present invention actually encompass random or block copolymers where one monomer type is an amine N-oxide and the other monomer type is an N-oxide or not.

The amine oxide unit of the polyamine N-oxides has a pKa<10, preferably pKa<7, more preferred pKa<6. The polyamine oxides can be obtained in almost any degree of polymerisation. The degree of polymerisation is not critical provided the material has the desired water-solubility and dye-suspending power. Typically, the average molecular weight is within the range of 500 to 1000,000; more preferred 1000 to 500,000; most preferred 5000 to 100,000.

The polyamine N-oxides of the present invention are typically present from 0.01 to 10%, more preferably from 0.05 to 1%, most preferred from 0.05 to 0.5% by weight of the dye transfer inhibiting composition.

The Compositions of the Invention

The present invention further encompasses compositions which are suitable for use in the textile treatment process of the present invention.

There are however additional problems associated with formulating compositions suitable for use in the process of the present invention. These problems which are dependant on whether the compositions are aqueous or non aqueous.

Aqueous compositions

We have found that it is not possible to formulate an aqueous composition comprising anionic species, a neutralizing system for said species comprising quaternary ammonium cations, peroxygen bleach and a metallo catalyst which is stable.

This is again due to the sensitivity of the activated metallo catalyst. The composition must therefore be formulated so that the activated species is only formed in the aqueous medium. This has been achieved by keeping the peroxygen bleach or the metallo catalyst separate from each other until the wash process begins. Thus one embodiment of the composition according to the present invention comprises an aqueous composition comprising anionic species, a peroxygen bleach and a neutralizing system for said anionic species. Said neutralizing system comprises quaternary ammonium cations and may additionally comprise inorganic salts such as sodium or potassium to partially neutralize the anionic species. However these systems do not comprise alkanolamines. This composition can optionally be mixed in the aqueous medium with another composition comprising metallo catalysts.

Non-aqueous compositions

Alternatively, in another embodiment of the invention a non aqueous composition comprising both the peroxygen bleach and the metallo catalyst would prevent the activation of the metallo catalyst in the composition. This is also in line with a trend to reduce the volume of detergent compositions due to environmental considerations and produce more compact detergent formulations by reducing the amount of non active ingredients such as water in detergent compositions. However, it has been established that anionic species fully neutralized by the usual neutralizing agents such as sodium or potassium hydroxide are not stable in these non-aqueous formulations and tend to set and/or precipitate upon storage. Indeed neutralizing systems based entirely on sodium hydroxide are not compatible with a non-aqueous environment and in such circumstances, the anionic species neutralized with sodium hydroxide tend to precipitate out of solution. Other neutralizing systems such as monoethanolamine are incompatible with peroxygen bleach as previously described herein. The quaternary ammonium cations of the neutralizing system of the present invention are compatible with a non aqueous environment and peroxygen bleach and metallo catalysts.

According to the present invention a neutralizing system comprising quaternary ammonium cations is compatible with a non-aqueous environment, peroxygen bleach and metallo catalysts. Additionaly, said neutralizing system may optionally further comprise a small amount of sodium or potassium hydroxide. However alkanolamines are not present.

The term non aqueous compositions as used herein refers to compositions which only contain less than 10% water, preferably less than 5%, most preferably less than 2% water.

An advantage of the compositions of the present invention is that the anionic species remain fully dissolved in the compositions and do not precipitate. Furthermore, the present invention may be formulated as a concentrated composition wherein the amount of non active ingredients in the composition is reduced.

According to the present invention the aqueous medium and the compositions of the present invention may further comprise a series of further, optional ingredients. Examples of suitable additives include solvents, pH adjusting agents, suds regulants, opacifiers, perfumes, dyes, bactericides, brighteners, soil release agents, softening agents, enzymes and other surface active ingredients and the like.

EXAMPLES

The following compositions are made by combining the following ingredients in the listed proportions.

Example I

An aqueous HDL formulation containing a mixed NaOH/TMAOH neutralizing system is given below (A):

| | Full Na | Formula A Mixed TMA/Na |
|---|---|---|
| NaOH | 3.5 | — |
| TMAOH | — | 6.6 |
| Citric acid | 2.5 | 2.5 |
| $NaC_{12}$ alkyl sulphate | 4.7 | — |
| $TMAC_{12}$ alkyl sulphate | — | 4.7 |
| $NaC_{13-15}$ Alkyl $(ether)_3$ Sulphate | 13 | 13 |
| $C_{12}$ polyhydroxy fatty acid amide | 6.4 | 6.4 |
| PEG 200 | 11.3 | 11.3 |
| EtOH | 3.8 | 3.8 |
| $C_{14-15}$ Ethoxylated Alcohol (7EO) | 3.7 | 3.7 |
| $C_{12-14}$ Fatty acid | 9.8 | 9.8 |
| DTPMP* | 1.4 | 1.4 |
| Brightener | 0.1 | 0.1 |
| Amylase | 0.1 | 0.1 |
| Protease | 0.5 | 0.5 |
| Cellulase | 0.006 | 0.006 |
| Lipolase | 0.3 | 0.3 |
| Soil Release Polymer | 0.4 | 0.4 |
| Polyethoxylated tetramethylene pentamine | 0.1 | 0.2 |
| Perfume | 0.5 | 0.5 |
| 2-butyl octanol | 1.4 | 1.4 |
| Dye Transfer Inhibiting polymer* | 0.1 | 0.1 |
| pH | 7.6 | 7.6 |
| Water | up to 100 parts | up to 100 parts |
| Stability (after 3 days at 20° C.) | precipitation | no precipitation |

Formula A exemplifies the process of the invention only.
DMPMP = Diethylene Triamine Penta Methylene Phosphonic acid
*Poly Vinylpyridine N-oxide Unlike the composition fully neutralized with NaOH, the composition neutralized with the mixed NaOH/TMAOH system does not show precipitation. Formula A can be used together with another composition containing a peroxygen bleach, optionally with a metallo catalyst if DTI performance is desired. This other composition can be in solid or in liquid form, as exemplified below:

| | Second composition | | |
|---|---|---|---|
| | B | C | D |
| $PB_1$ | 25 | 10 | 12 |
| FeTPPS* | — | 2 | — |

-continued

| | Second composition | | |
|---|---|---|---|
| | B | C | D |
| MnPC*** | — | — | 3 |
| Nonionic surfactant** | 65 | 83 | 80 |
| Stabilizers/deflocculants | 10 | 5 | 5 |
| Total parts | 100 | 100 | 100 |

*FeTPPS = Iron Tetra Phenyl Porphyrin Sulfonate
**Liquid above 10° C.
***MnPC = Manganese Phthalocyamine Sulfonate For example, 100 g of formula A can be mixed together with (i) 40 g of formula B, or (ii) 4.5 g of formula C, or 3 g of formula D, to provide in an aqueous medium a detergent composition with good detergency properties.

Example II

A HDL composition containing a lower water level and anionic species neutralized by a mixed NaOH/TMAOH system is given below (D):

| | Formula D | |
|---|---|---|
| | TMA formula | NaOH formula |
| PEG 200 | 35 | 35 |
| $C_{14-15}$ Ethoxylated Alcohol (3EO) | 15 | 15 |
| $C_{14-15}$ Ethoxylated Alcohol (7EO) | 10 | 10 |
| $C_{12}$ polyhydroxy fatty acid amide | 10 | 10 |
| $H_3BO_3$ | 1.3 | 1.3 |
| $NaC_{12}$ Alkyl sulphate | 8 | 8 |
| Fatty acids | 13 | 13 |
| TMAOH | 3.5 | — |
| NaOH | — | 2.3 |
| water* and minors up to | 100p | 100p |
| Stability (after 3 days r.t.) | clear transparent liquid | clear transparent stiff gel |

water* from raw materials

This composition D is a clear transparent liquid while the same composition fully neutralized by NaOH is a stiff gel.

This composition can be used together with a second composition containing peroxygen bleach with/without metallo catalyst such as formulae B, C, D in example I, to provide in the aqueous medium a detergent composition with good detergency properties.

Example III

An aqueous peroxygen bleach-containing HDL composition comprising TMA.OH as neutralizing agent is given here below (E):

| | Formula E |
|---|---|
| $C_{12}$ Linear alkyl benzene sulphonate | 12 |
| $C_{12-14}$ Alkyl Sulphate | 2 |
| $C_{12-14}$ Alcohol ethoxylate EO7 | 7 |
| $C_{12-14}$ alkenyl succinic acid | 8 |
| Oleic acid | 3 |
| Citric acid monohydrate | 0.8 |
| DTPMP* | 0.4 |
| Acrylate/maleate copolymer | — |

-continued

| | Formula E |
|---|---|
| Sodium perborate monohydrate | 10 |
| Protease | 0.6 |
| Sodium formate | 1 |
| Brightener | 0.15 |
| Perfume | 0.4 |
| Ethanol | 10 |
| TMAOH | 5 |
| NaOH up to pH | 10 |
| Water and minors | up to 100 parts |

where:
DTPMP = Diethylene Triamine Penta Methylene Phosphonic acid

Composition D can be used at 100 g. usage together with (i) .0.5 g of metallo-catalyst added separately in the aqueous medium, either as a powder or as a suspension or solution in an aqueous or anhydrous liquid composition.

Example IV

A substantially nonaqueous liquid detergent composition comprising anionic species, quaternary ammonium cations, peroxygen bleach, metallo catalyst and a DTI polymer is given below:

| | |
|---|---|
| PEG 200 | 33 |
| $C_{14-15}$ Alcohol Ethoxylate E03 | 12.5 |
| $C_{14-15}$ Alcohol Ethoxylate E07 | 12.5 |
| $C_{12}$ polyhydroxy fatty acid amide | 8.5 |
| Boric acid | 1 |
| TMA $C_{12}$ Alkyl sulphate | 12.5 |
| Palm Kernel Fatty Acids (PKFA) | 11 |
| TMA-OH | 4.5 |
| Manganese phthalocyanine sulphonate | 0.05 |
| Sodium perborate monohydrate | 0.5 |
| Poly vinylpyridine N-oxide | 0.2 |
| Water and minors | up to 100 parts |

This composition can be dissolved in the aqueous medium to provide good detergency and DTI benefits on fabrics.

We claim:

1. A detergent composition comprising anionic species, a bleach, a neutralizing system for the anionic species, less than 10% water and optionally a metallo catalyst, wherein the composition is in a liquid form and the neutralizing system comprises quaternary ammonium cations according to the formula:

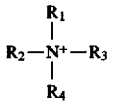

wherein each of $R_1$, $R_2$, $R_3$ and $R_4$ are independently $C_1$–$C_6$ alkyl, phenyl, hydroxyalkyl or alkoxyalkyl groups, wherein said composition is essentially free of alkanolamines.

2. A composition according to claim 1, wherein said anionic species comprises an anionic surfactant.

3. A composition according to claim 2, wherein said anionic surfactant is an alkyl alkoxylated sulphate.

4. A composition according to claim 1, wherein said anionic species comprises a builder.

5. A composition according to claim 1, further wherein said composition comprises polyamine N-oxide containing polymers.

6. A composition according to claim 1, wherein said metallo catalyst comprises a centred atom selected from iron, manganese, cobalt, chromium, rhodium, ruthenium and molybdenum.

7. A composition according to claim 1 comprising metallo catalyst at a level such that the concentration of metallo catalyst in a wash solution is from $10^{-8}$ to $10^{-3}$ molar.

8. A composition according to claim 1, wherein the composition remains a stable liquid after 3 days at room temperature.

9. A composition according to claim 1, comprising tetramethyl ammonium hydroxide.

10. A composition according to claim 1, wherein the composition comprises less than 5% water.

11. A process for treating textiles comprising the steps of:

(a) providing a first laundry composition comprising less than 10% water, a bleach and a metallo catalyst, wherein said first composition is essentially free of alkanolamines;

(b) providing a second laundry composition comprising an anionic species and a neutralizing system comprising a quaternary ammonium cation of the formula:

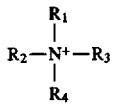

wherein each of $R_1$, $R_2$, $R_3$ and $R_4$ are independently $C_1$–$C_6$ alkyl, phenyl, hydroxyalkyl or alkoxyalkyl groups, wherein said second composition is essentially free of alkanolamines;

(c) mixing the first laundry composition and the second laundry composition with water to form a wash solution; and (d) contacting the textiles with the wash solution.

12. A process according to claim 11, wherein the quaternary ammonium cation is tetramethyl ammonium.

13. A process according to claim 11, wherein the anionic species is an anionic surfactant.

14. A liquid composition comprising anionic surfactant, tetramethyl ammonium hydroxide, bleach and less than 10% water.

15. A liquid composition according to claim 14, wherein the composition remains a stable liquid after 3 days at room temperature.

16. A liquid composition according to claim 14, further comprising a metallo catalyst.

17. A liquid composition according to claim 16, further comprising polyamine N-oxide polymer.

18. A liquid composition according to claim 16, comprising less than 5% water.

* * * * *